US005372166A

United States Patent [19]

Lai

[11] Patent Number: 5,372,166

[45] Date of Patent: Dec. 13, 1994

[54] TIE-WRAP TOOL

[76] Inventor: Chang-Keng Lai, No. 8-6, Chung Ho Rd., Ta Ya Tsun, Ta Ya Hsiang, Taichung Hsien, Taiwan, Prov. of China

[21] Appl. No.: 96,405

[22] Filed: Jul. 26, 1993

[51] Int. Cl.[5] ..... B21F 9/02

[52] U.S. Cl. ..... 140/123.6; 140/93.2

[58] Field of Search ..... 140/93 A, 93.2, 93.4, 140/123.5, 123.6

[56] References Cited

U.S. PATENT DOCUMENTS 4,733,701 3/1988 Loisel et al. ..... 140/123.6

*Primary Examiner*—Lowell A. Larson

*Attorney, Agent, or Firm*—Bacon & Thomas

[57] ABSTRACT

A conventional tie-wrap is tightened and cut in a one-step operation by a tool having gripping and actuating handles pivotally secured together and a pair of guiding plates movably mounted to side panels of the actuating handle by three axle bolts which also serve to secure a blade, a tensioning spring and a torsion spring. When the handles are compressed together against the bias of the torsion spring, a bracing block secured to the gripping handle grips the tie-wrap while the actuating handle tightens the wrap around the articles to be secured. Further compressing of the actuating handle causes the blade to be urged towards the tie-wrap against the bias of the tensioning spring to cut the wrap.

3 Claims, 6 Drawing Sheets

TIE-WRAP TOOL

BACKGROUND OF THE INVENTION (a) Field of the Invention

The present invention relates to a tie-wrap tool, more specifically, the present invention relates to a tie-wrap tool which can handle the tying and cutting of the tie-wrap in a single operation.

(b) Description of the Prior Art

A conventional tie-wrap cutter is shown in FIG. 6. This cutter includes an actuating handle 10 and a gripping handle 20 which are pivotally joined together. A blade is attached and pivotally connected to this tool for cutting purpose. The actuating handle 10 and the gripping handle 20 provide the tying and tightening of the tie-wrap. After the tie-wrap is tighten, an attached handle 30 is pressed to drive a blade 40 to cut the unused end of the tie-wrap. The conventional cutter portion includes an attached handle 30, a blade 40 and a torsion spring 50. The actuating handle 10 and the gripping handle 20 are pivotally joined together with a torsion spring 60. Thus, the conventional tie-wrap tool has a cutting device attached to the actuating handle to form a linkage assembly. This is a very impractical arrangement.

SUMMARY OF THE INVENTION

The main object according to the present invention is to provide a 2-in-1 tie wrap tool such that the tightening and cutting of the tie-wrap can be carried out with one tool in a single operation.

Another object according to the present invention is to provide an improved structure for a tie-wrap cutter in which three axle bolts are used to movably mount two guiding plates on the side panels of an actuating handle, and the middle bolt provides a hook-on for a tension spring. An adjustment screw rod is fed through the tension spring such that the screw rod adjusts the tension of the spring, which in turn alters the tightening of the tie-wrap and provides for cutting at the same time.

BRIEF DESCRIPTION OF THE DRAWINGS

The drawings disclose an illustrative embodiment of the present invention which serves to exemplify the various advantages and objects thereof, and are as follows.

DETAILED DESCRIPTION OF THE PREFERRED EMBODIMENT

Figure 1:
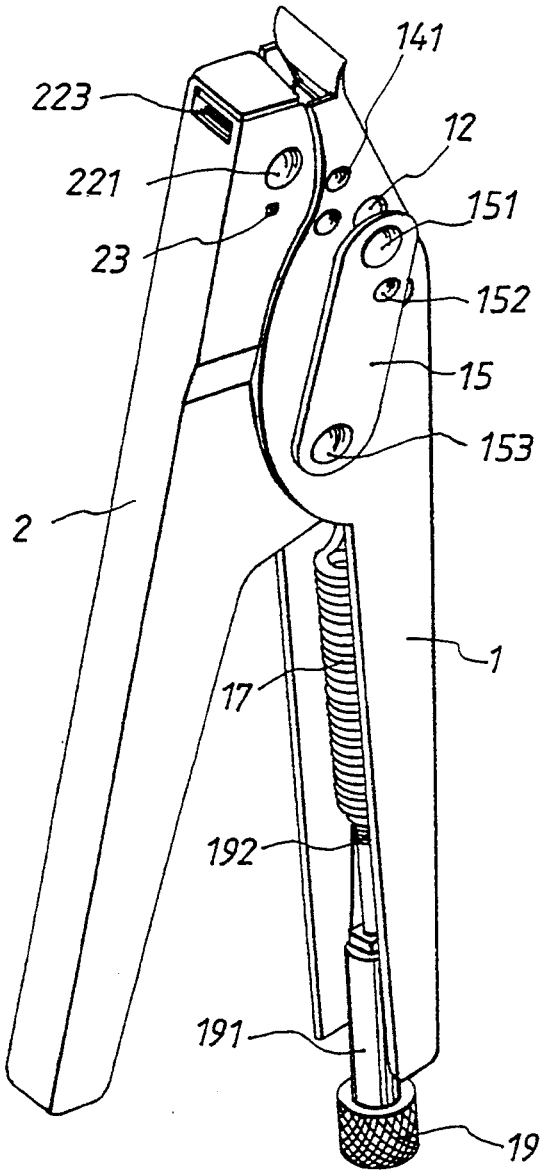
FIG. 1 is a perspective view of a tie-wrap tool according to the present invention.
Figure 2:
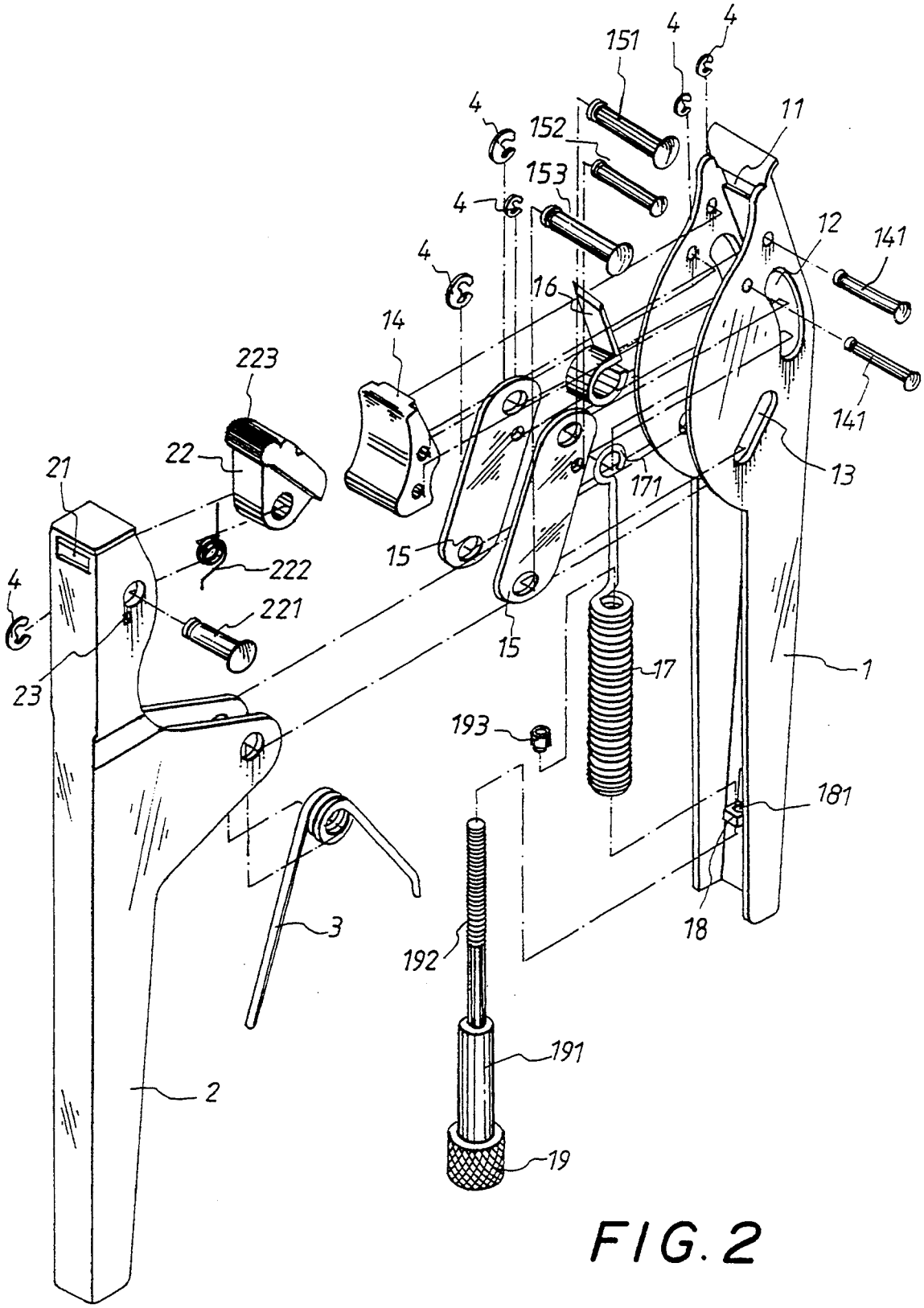
FIG. 2 is a perspective exploded view of the tie-wrap tool according to the present invention.
Figure 3:
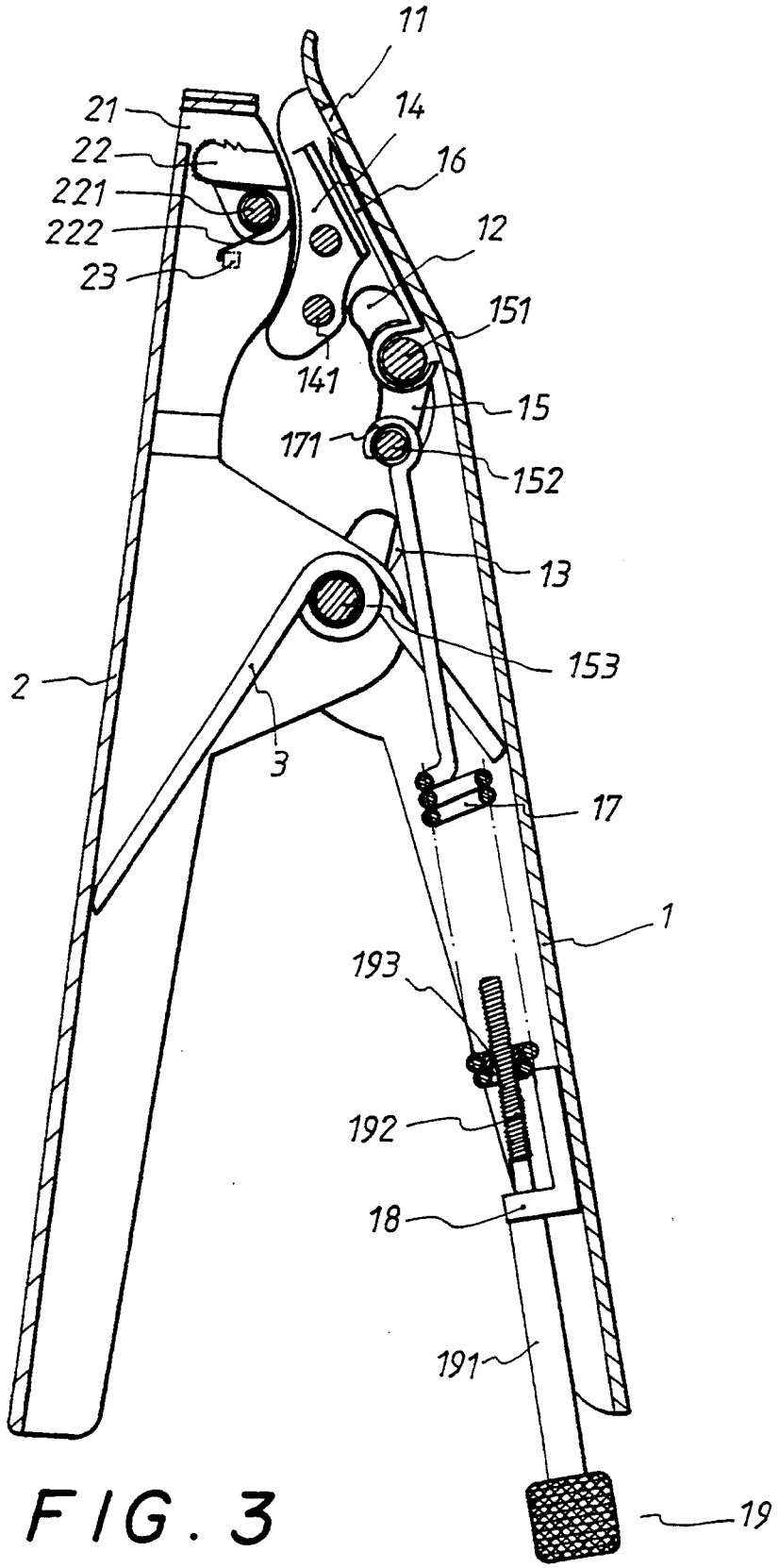
FIG. 3 is a cross-sectional view of the tie-wrap tool according to the present invention.

As shown in FIG. 1 through FIG. 3, the improved structure of the tie-wrap cutter according to the present invention includes an actuating handle 1, a gripping handle 2 and a torsion spring 3.

The actuating handle 1, having a tie-wrap feed-in hole 11 at its forward portion, also has two long slotted holes 12 and 13 which are arranged in selected upper and lower positions adjacent to each other in the two side panels. In the forward portion of the long slotted hole 12 is a holding block 14 which is fitted within the two side panels and is secured by a hold-down bolt 141. Three axle bolts 151, 152 and 153, together with their associated lock washers 4, are used to movably mount two guiding plates 15 on the side panels. The front axle bolt 151 and the middle axle bolt 152 are arranged in the upper slotted hole 12 and the rear axle bolt 153 is arranged in the lower slotted hole 13. The front axle bolt 151 also positions and secures a cutter blade 16. The end portion of the blade 16 forms a hook which can be looped around the front axle bolt 151. The middle axle bolt 152 also provides a tension spring 17 which has an end hook 171 for securing it in position. The rear axle bolt 153 feeds through the actuating handle 1 and the gripping handle 2 and is used to secure the torsion spring 3 between the two handles 1 and 2.

The gripping handle 2, has a tie-wrap feed-out hole 21 at its forward portion, under which is an axle bolt 221 which feeds from the front side of the gripping handle 2, through a tiny torsion spring 222 and a bracing block 22, and comes out from the rear side of the gripping handle 2. The bracing block 22 is also movably mounted, allowing one end of the tiny torsion spring 222 to engage against a blocking plate 23 inside the side panel of the handle 2, the other end of spring 222 being engaged against the step surface of the bracing block 22. The forward portion of the bracing block 22 is designed with an appropriate teeth-mark surface 223 which is used to press against the holding block 14 of the actuating handle 1. Normally, the holding block 14 is being engaged against the bracing block 22, allowing the bracing block 22 and the tie-wrap feed-out hole 21 to maintain an appropriate gap, as is shown in FIG. 3.

The aforesaid actuating handle 1 has a positioning block 18 in an inside wall at its rearward end. The positioning block 18 has a central hole 181 which is specially constructed to allow an adjustment screw rod 19 to feed through. The step portion 191 at the rear end of the screw rod 19 is fed through and pressed against the positioning block 18. The front end threaded portion 192 of the screw rod 19 is fed through the tension spring 17, and screwed into a nut 193 which is attached to the end of the spring 17. Thus the tightening or loosening of the screw rod 19 with respect to the nut 193 produces a tension to press or stretch the tension spring 17.

Figure 4:
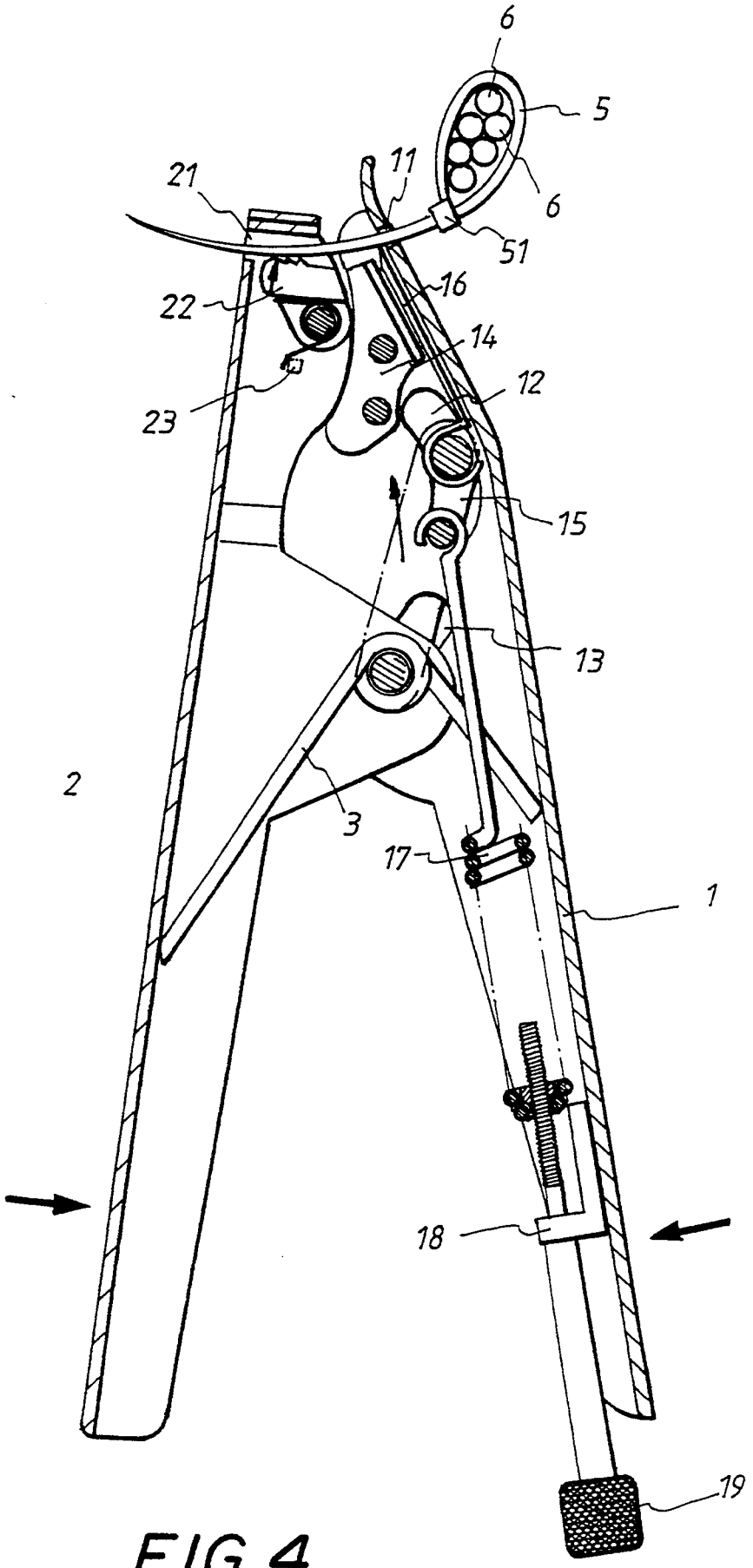
FIG. 4 shows a tie-wrap being fed through the tool in preparation for tying according to the present invention.
Figure 5:
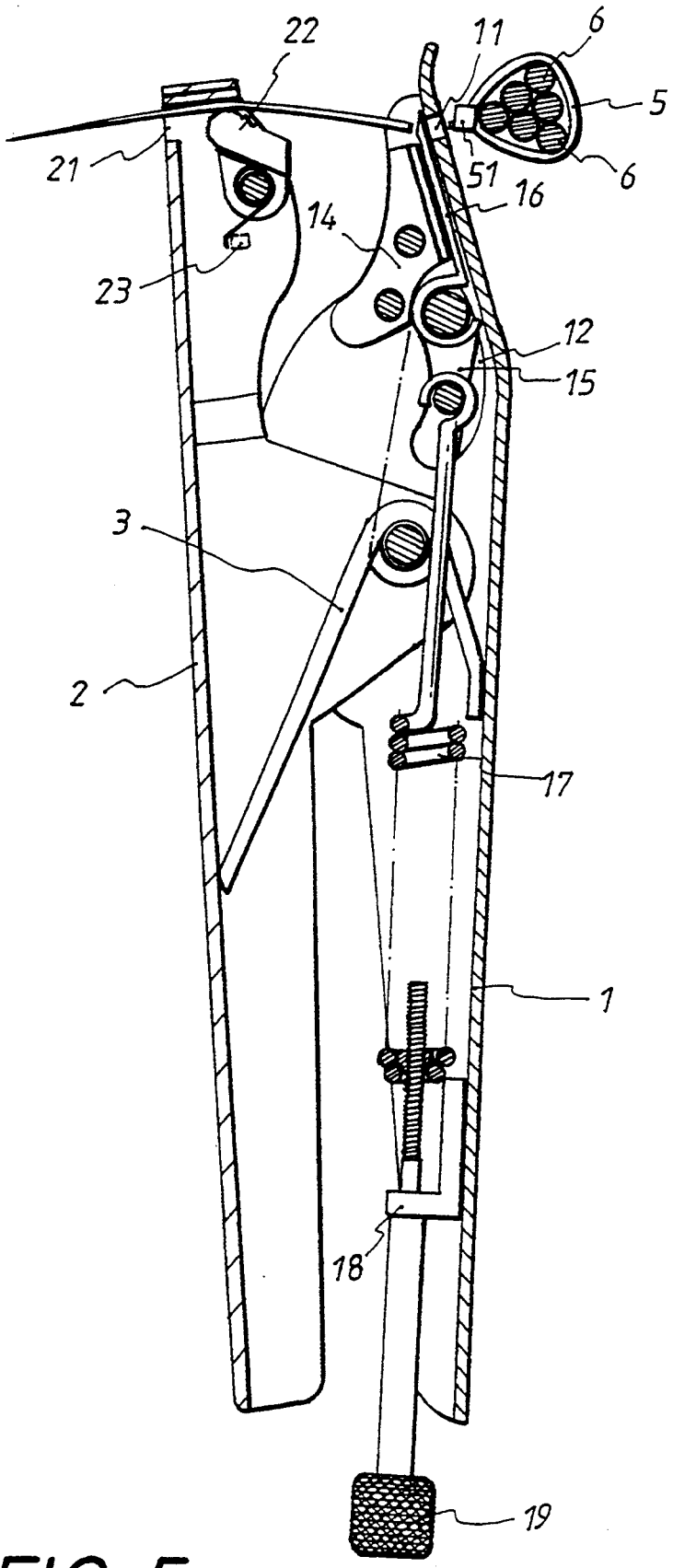
FIG. 5 shows a tie-wrap being cut with the tool in a cutting position according to the present invention.
Figure 6:
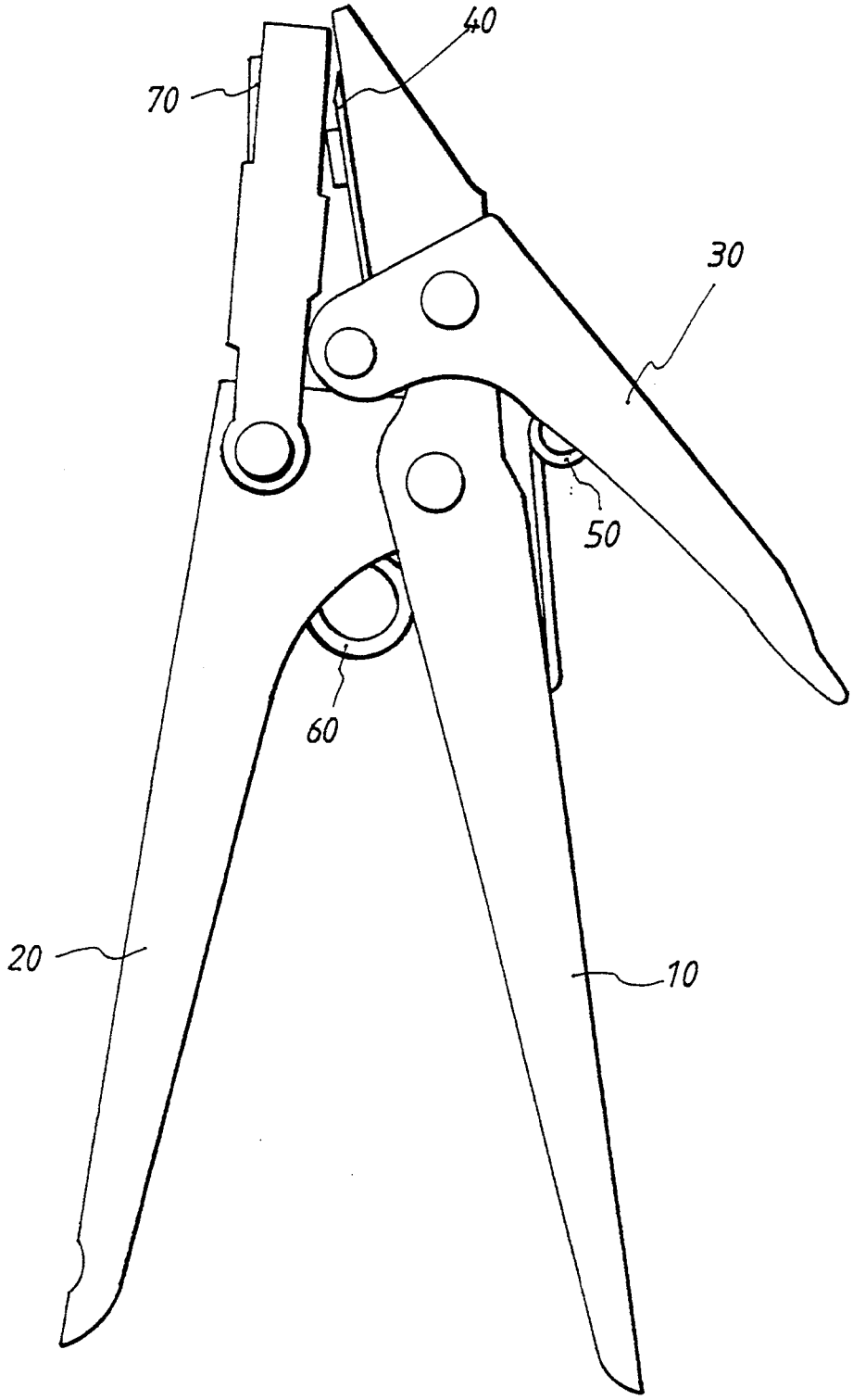
FIG. 6 PRIOR ART
FIG. 6 is a diagrammatic view of a conventional tie-wrap cutter.

Using the above parts and components, the cutter according to the present invention can be used to set the tie-wrap 5 to a position ready to tie the circular bodies 6 together, as shown in FIG. 4. First the tapered end of the tie-wrap 5 is fed into the feed-in hole 11 and pulled out from the feed-out hole 21 of the cutter according to the present invention. Hand pressure can then be applied by pressing the handles 1 and 2 such that the actuating handle 1 is stretched out to one side, allowing the tie-wrap 5 to tie the circular bodies 6 together securely. While the handles are being pressed, the holding block 14 and the bracing block 22 are separated from each other. Thus the tiny torsion spring 222 pushes the bracing block 22 to grip the end of the tie-wrap 5 tightly. Hence, the actuator handle 1 is used to pull the tie-wrap 5 to a tight and solid position. When the tie-wrap 5 is tightened the applied pressure is completed. Continuing to press the handle causes the tension spring 17 to urge the guiding plates 15 to slide on the upper and the lower slotted holes 12 and 13. This sliding movement of the guiding plates 15 pushes the blade 16 to cut the unused end portion of the tie-wrap 5, as is shown in FIG. 5. Therefore, the tie-wrap cutter according to the present invention can tighten the tie-wrap and cut its unused portion in a one step operation. In addition, the tension in the tension spring 17 is adjustable so that the tightening force applied to the tie-wrap 5 can also be adjusted and the unused portion can be cut away accordingly.

In use, the long tie-wrap 5 is pulled to form a knot 51 at its forward end. To tie something together, the surface with the teeth marking of the tie-wrap 5 is bent inward to feed through the knot 51, allowing a one-way tightening of the material without loosening. The tie-wrap 5 used in the embodiment is a conventional article and is therefore not being described herein.

The cutter according to the present invention does not have an attachment handle like a conventional tie-wrap cutter. Its operation can be carried out with one hand. The gripping handle 2 can be laid down on the table top or similar surface so that full strength can be applied to the actuating handle 1 to cut the end portion of the tie-wrap easier. Therefore, the 2-in-1 tie-wrap tool according to the present invention is a practical tool when compared to a conventional tie-wrap tool.

Although one embodiment of the invention is illustrated in the drawings and described in detail, this invention contemplates any change in configuration, design and relationship of components which will function in a similar manner and provide the equivalent result.

What is claimed is:

1. A tie-wrap tool comprising:

a) an actuating handle and a gripping handle pivotally secured together;

b) the actuating handle including a feed-in hole at a forward portion thereof, a holding block secured adjacent the feed-in hole, a pair of spaced side panels, each side panel having an upper slotted hole and a lower slotted hole formed therein;

c) a pair of guiding plates, a front axle bolt, a middle axle bolt and a rear axle bolt, each guiding plate being movably mounted to a side panel of the actuating handle by the front and middle axle bolts extending through the upper slotted holes and the rear axle bolt extending through the lower slotted holes;

d) a cutter blade secured to the front axle bolt;

e) the rear axle bolt pivotally securing the handles together and a torsion spring carried by the rear axle bolt for urging the handles apart;

f) a tensioning spring having first and second ends, the first end being secured to the middle axle bolt and means securing the second end to the actuating handle at a rearward portion thereof; and g) the gripping handle including a feed-out hole at a forward portion thereof and a bracing block movably secured adjacent the feed-out hole.

2. The tie-wrap tool of claim 1 wherein the means securing the second end of the tensioning spring to the rearward portion of the actuating handle includes:

a) a positioning block carried by the handle; and b) a screw rod connecting the tensioning spring to the positioning block for adjusting the tension of the spring.

3. The tie-wrap tool of claim 1 wherein:

a) the bracing block includes:

i) a toothed surface; and ii) a spring for urging the bracing block into engagement with a tie-wrap extending through the feed-out hole.

* * * * *